US005144818A

United States Patent [19]

Brandani

[11] Patent Number: 5,144,818

[45] Date of Patent: Sep. 8, 1992

[54] CONTROL DEVICE AND METHOD FOR ELECTROMAGNETIC NEEDLE SELECTION IN CIRCULAR KNITTING MACHINE

[75] Inventor: Paolo Brandani, Scandicci, Italy

[73] Assignee: Savio S.p.A., Pordenone, Italy

[21] Appl. No.: 619,750

[22] Filed: Nov. 28, 1990

[30] Foreign Application Priority Data

Dec. 1, 1989 [IT] Italy ..... 22566 A/89

[51] Int. Cl.[5] ..... D04B 15/78

[52] U.S. Cl. ..... 66/219; 66/232

[58] Field of Search ..... 66/218, 219, 232

[56] References Cited

U.S. PATENT DOCUMENTS 3,760,610 9/1973 Hadam et al. .
4,055,058 10/1977 Tewsley et al. ..... 66/219
4,081,974 4/1978 Jaffe et al. .

FOREIGN PATENT DOCUMENTS 0279234 5/1990 European Pat. Off. .
0379234 5/1990 European Pat. Off. .
2205750 8/1973 Fed. Rep. of Germany ..... 66/219
2540498 3/1976 Fed. Rep. of Germany .
2194970 3/1988 United Kingdom .

*Primary Examiner*—Werner H. Schroeder
*Assistant Examiner*—John J. Calvert
*Attorney, Agent, or Firm*—Shea & Gould

[57] ABSTRACT

Needle selection is effected by an assembly fixed on and rotating with the cylinder and consisting of a plurality of horizontal jacks selected by controlled electromagnets, and an electronic control system. The assembly is provided with Hall sensors which receive magnetic pulses from stationary coil positioned around the rotating assembly.

8 Claims, 4 Drawing Sheets

FIG. 3
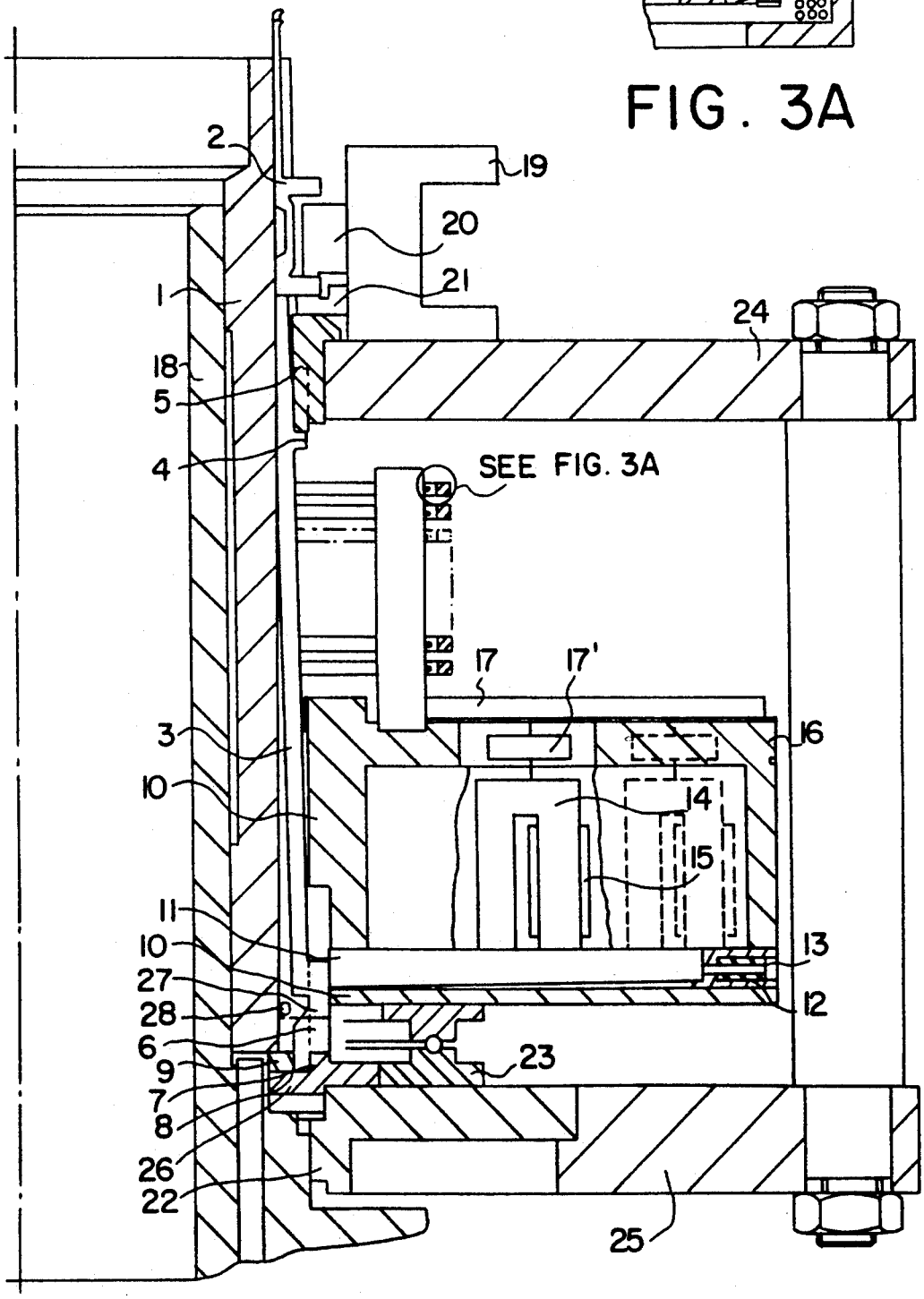
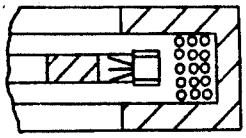
FIG. 3A

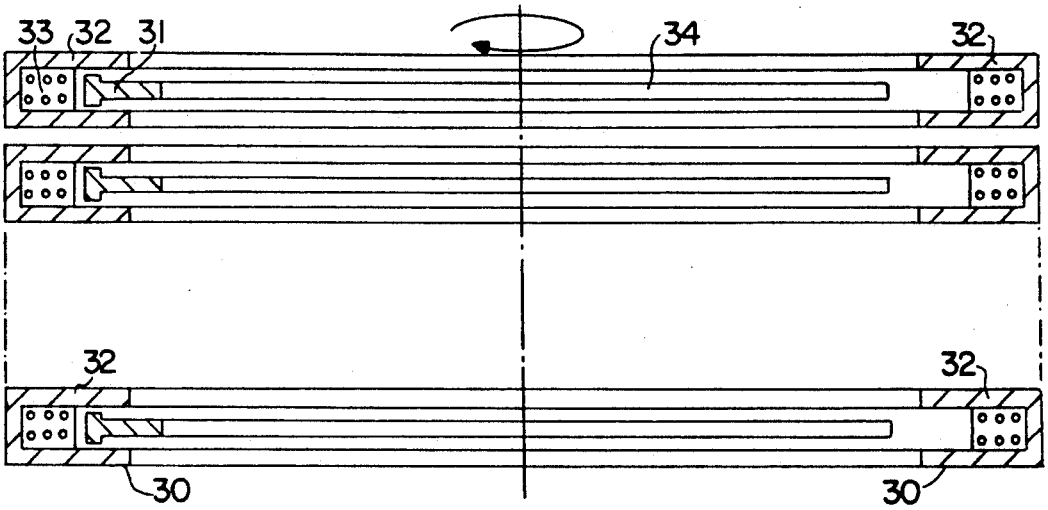
FIG. 4
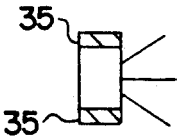
FIG. 4A
FIG. 6
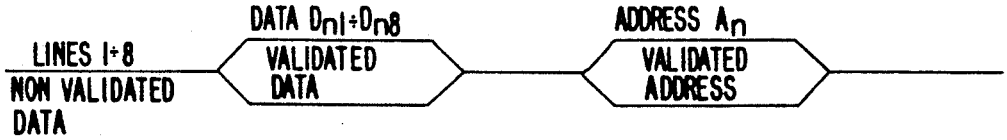
FIG. 6A
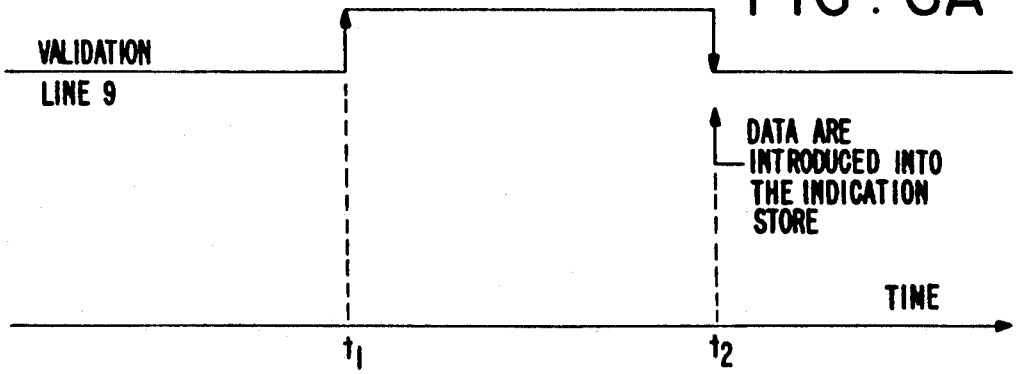

CONTROL DEVICE AND METHOD FOR ELECTROMAGNETIC NEEDLE SELECTION IN CIRCULAR KNITTING MACHINE

BACKGROUND OF THE INVENTION

This invention relates to circular knitting machines, and in particular to needle selection in such machines, for example to produce embroidered, patterned or net stockings.

The invention provides a device and method for needle selection in which the selection is made at each yarn feed by rapidly and accurately separating those needles to be raised in order to seize the new yarn for working purposes, from those needles to remain inactivated at the lowest level.

In the known art the selection devices are fixed and operate on the vertical jacks which raise the needles into activation when said vertical jacks, during their rotation together with the cylinder, appear in front of the fixed selection station which precedes the fixed yarn feed station.

As a circular knitting machine has between 200 and 400 needles, between one and four or more yarn feed stations and a rotational speed of up to 1500 r.p.m., and may well require the selection to be made needle by needle, the selection device is vary complicated and difficult to construct, and also difficult to control.

The time available for setting, initiating and completing the selection is very small, being of the order of a few thousandths of a second, and determined by the small angular sector within which the rotating vertical jacks face the selection member, which for its part must be immediately ready to select those needles or more precisely those needle jacks which at that moment are presented to them.

Most recently, the solution to the problem has turned towards mobile selection devices rotating together with the circular machine, so that the time available for selection is not limited to the moment in which the jacks appear before the stationary selection device. In this manner each vertical jack is constantly presented to its selection member, so that the selection can take place in any angular position or at any time as required. In this manner the selection setting time is not so drastically small and the selection can be effected reliably and safely.

In Italian patent application 9314A/89, this needle selection is effected by controlling the radial position of the vertical jacks by means of corresponding horizontal jacks which slide radially in grooves provided in a circular ring structure surrounding the cylinder. The horizontal jacks are selected by electromagnetic retention devices, which are either energized or not energized. Those electromagnetic devices which are energized retain the horizontal jack in its most outer position to activate the corresponding needles, in that their vertical jack is left in its outer position to be lifted by the provided for this purpose. Those electromagnetic devices which are not energized do not retain the horizontal jack, and allow it to return inwards under the action of a thrust spring. Said jack in its turn urges the corresponding vertical jack inwards to leave its needle in the inactivation position. Thus one vertical jack, one horizontal jack and one selection electromagnet are provided for each needle of the circular machine.

In a circular machine the number of needles varies from about 200 to 400, as stated, and the whole assembly of needles, jacks and electromagnetic selection devices rotates together with the machine cylinder at a speed which can reach 1500 r.p.m.

Electrical power has to be fed to this rapidly rotating assembly, normally by sliding contacts, as do the selection commands for the needles, which have to lie in a precise attitude needle by needle before encountering the yarn feed stations, which are positioned at regular intervals about the cylinder.

SUMMARY OF THE INVENTION

The present invention provides a device and method for the contactless magnetic transmission of needle selection commands to the rotary assembly comprising the horizontal jacks and relative selection electromagnets by the machine control system, which remains stationary.

From the electrical and electronic viewpoint the system can be considered to consist of a number of electromagnets equal to the number of needles rotating together with the needle cylinder, and which have to be punctually operated to select the needles.

The machine control system, which must necessarily be stationary provides the necessary synchronism and manages the machine other resources, whereas the rotating electronic part, even if reduced to its minimum terms, must consist of at least one control circuit for each electromagnet, memories and decoder circuits. Each piece of information transmitted contains "data and addresses", i.e. for each electromagnet to be controlled, the information must show whether it is to be energized or not, and to which electromagnet the command refers.

BRIEF DESCRIPTION OF THE DRAWINGS

FIG. 3 is a cross section of the configuration of a circular knitting machine with a mobile needle selection assembly.

FIG. 3A shows the position of a sensor.

FIG. 4 is a detail view of a particular embodiment of a sensor.

FIG. 4A is a Hall Sensor with attached ferromagnetic plates.

FIGS. 6 and 6A are block diagrams illustrating validation.

DETAILED DESCRIPTION

Figure 1:
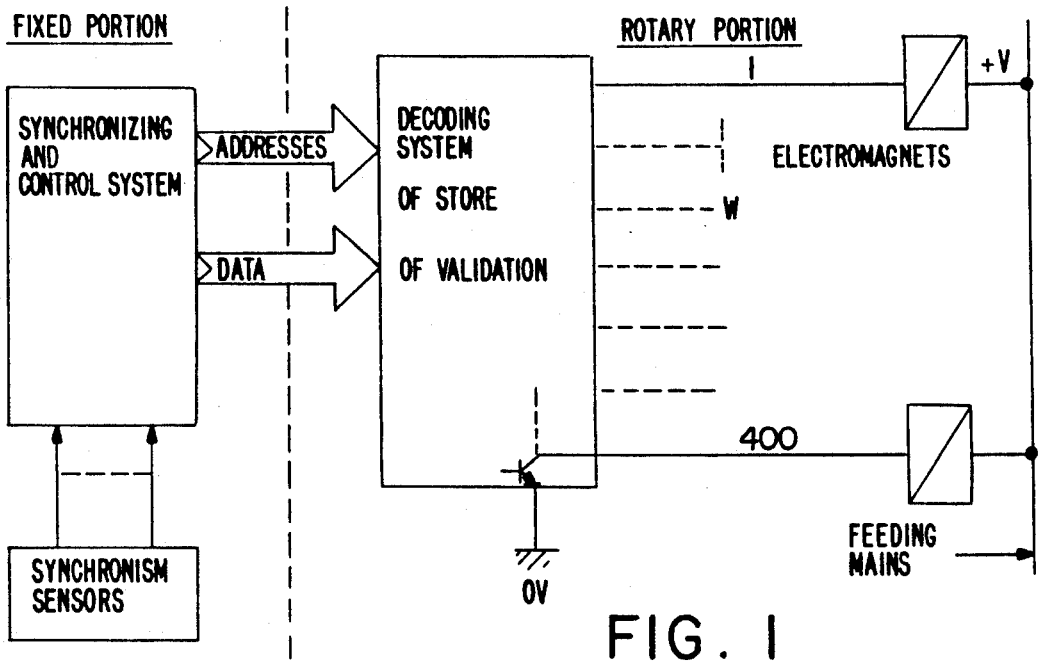
FIG. 1 is a block diagram illustrating a control system according to the present invention.

The block diagram of FIG. 1 shows the main parts of the control system, and it can be seen that if there was not a combination of stationary and moving parts there would be no particular transmission problem in controlling 400 electromagnets with the correct synchronism.

The technical problem to be solved arises precisely because one part of the system is fixed whereas the other part rotates, and that the organized digital electronic information representing data and addresses must be transferred from one to the other part with due regard for synchronization and without contact between the parts.

Figure 2:
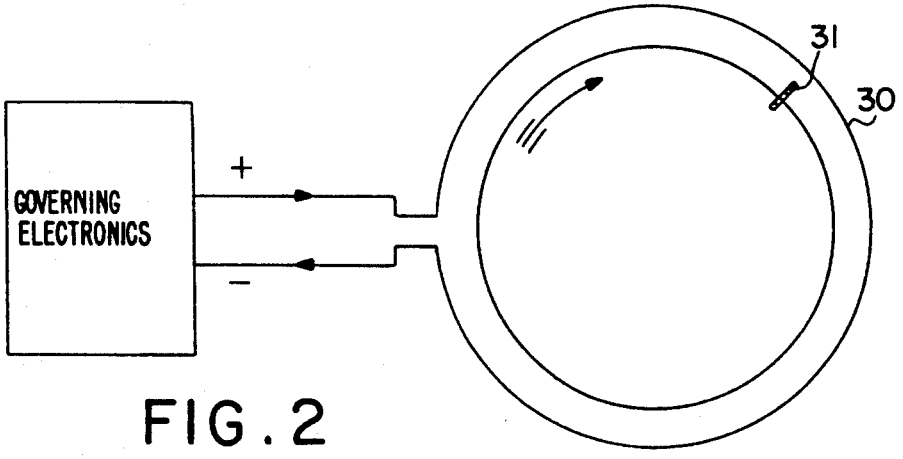
FIG. 2 is a schematic diagram of a sensor.

The present invention consists of an induction transmission channel for digital information, known as a bus, for the passage of data and associated addresses from the stationary part to the rotary part, and shown schematically in FIG. 2.

The circular machine is provided for each bus line with a fixed magnetic ring coil 30 of sufficient diameter to contain the machine needle cylinder and the receiver sensors which rotate with it.

The stationary electronic control system of the machine feeds the ring coils 30 with suitable pulse trains.

To better illustrate the characteristics and advantages of the present invention FIG. 3 schematically shows by way of example the configuration of a circular knitting machine with a mobile needle selection assembly fixed on the cylinder and rotating with it.

FIG. 3 shows the following members:

1 needle cylinder
2 needle
3 vertical jack
4 upper guide butt on vertical jack
5 vertical jack lowering cam
6 vertical jack raising butt
7 vertical jack raising cam
8 lower guide butt on vertical jack
9 radial cam for vertical jack
10 guide ring structure for horizontal jacks
11 horizontal jack
12 thrust spring for urging horizontal jack inwards
13 adjustment screw
14 electromagnetic retention core
15 its energizing coil
16 electrical power transmission tracks
17/17' electronic system on cylinder
18 cylinder support
19 support for cams 20 and counter-cams 21 which control switch formation
22 cylinder centering plate
23 thrust bearing supporting the ring structure 10
24 intermediate fixed holding plate for the support 19
25 fixed base plate conjugate with 24 by an upright
26 lower support ring for the cams 7 and 9.

With each fixed magnetic ring coil 30 positioned about or coaxial to the circular machine cylinder there corresponds an electromagnetic sensor 31 positioned on the machine cylinder and rotating with it as part of the selection assembly to constantly explore the space between the pole pieces of the coil 30 and receive the magnetic pulses from them.

The coil, which is described hereinafter in greater detail, comprises pole pieces the magnetic polarity of which depends on the energization they receive from current circulating through the winding.

The sensor 31 is a Hall sensor, which generates a voltage proportional to the magnetic field in which it is immersed.

FIG. 4 is a sectional view of the coils and sensors provided on the circular knitting machine.

The stationary coil 30 is formed from a circularly extending channel section containing in its interior a winding 33 made from several turns of an electrical conductor and energized with electric current to induce magnetic polarity in the pole pieces of the channel section.

The sensor 31, which rotates with the cylinder 1 and is fixed to it by a suitably balanced support 34 extends into proximity with, or actually into, the cavity in the section 32 and travels along its circular contour, to be exposed to the magnetic field generated (or not generated) in the pole pieces by the electrical current which is (or is not) circulated through the winding 33.

The enlarged detailed view of FIG. 4 shows a particular embodiment of the sensor 31 in which the performance of the Hall sensor is increased by positioning ferromagnetic plates 35 on its surface to concentrate the magnetic flux onto the sensor.

During those time periods in which the stationary winding 33 is energized with electrical pulses, the rotating sensor 31 is energized by the corresponding magnetic fields to generate corresponding electrical pulses which are fed to the electronic needle selection system positioned on the needle cylinder 1 and rotating with it.

This transmission takes place in any angular position of the sensor 31 and at any time, without having to wait for particular angular correspondence between the stationary and rotating parts, as in the case of currently used circular machines.

In the description given hereinafter reference is made by way of non-limiting example to a circular machine with 400 needles, this being the most frequent case, however it must be noted that the invention can be advantageously applied also to machines provided with a different number of needles.

The number of such transmission channels or buses must be sufficient for passing the information consisting of control data and addresses to all the 400 selection electromagnets. The limiting case would be to provide 400 buses, one for each needle, so eliminating the need for address information and transmitting only on/off data.

This hypothetical arrangement would considerably simplify the transmission procedure and the electronic system on the cylinder, but would considerably complicate the transmission and reception device and the synchronization devices.

According to one transmission method, which is a preferred embodiment of the present invention, the needles or rather electromagnets are considered in groups.

In this preferred method of the invention, the total number of needles is divided into groups of equal needle numbers, the transmitted information having as its address the group of needles to which it is directed and providing an on and off sequence which refers to the progressive series of needles contained in the group and is to be fed to the corresponding selection electromagnets.

By way of non-limiting example, with reference to a machine provided with 400 needles, these needles are divided into groups of 8 needles to form 50 groups identified by 50 addresses, and for each of which there is provided at the right time and place an item of data comprising a sequence of 8 signals which provide the command for the energizing or non-energizing of each individual one of the 8 electromagnets corresponding to the 8 needles of the group. Again considering 400 needles, the groups could each consist of 4, 5, 8, 10, 16 or more needles without this changing the substance of the method. In the case of groups of 8 needles, the remote transmission of the information in binary code requires only 9 buses or channels, of which 8 are used for the remote transmission of the information and the other for its validation. On the basis of this illustrative division, the method for remote data transmission and needle selection control is as follows.

Figure 5:
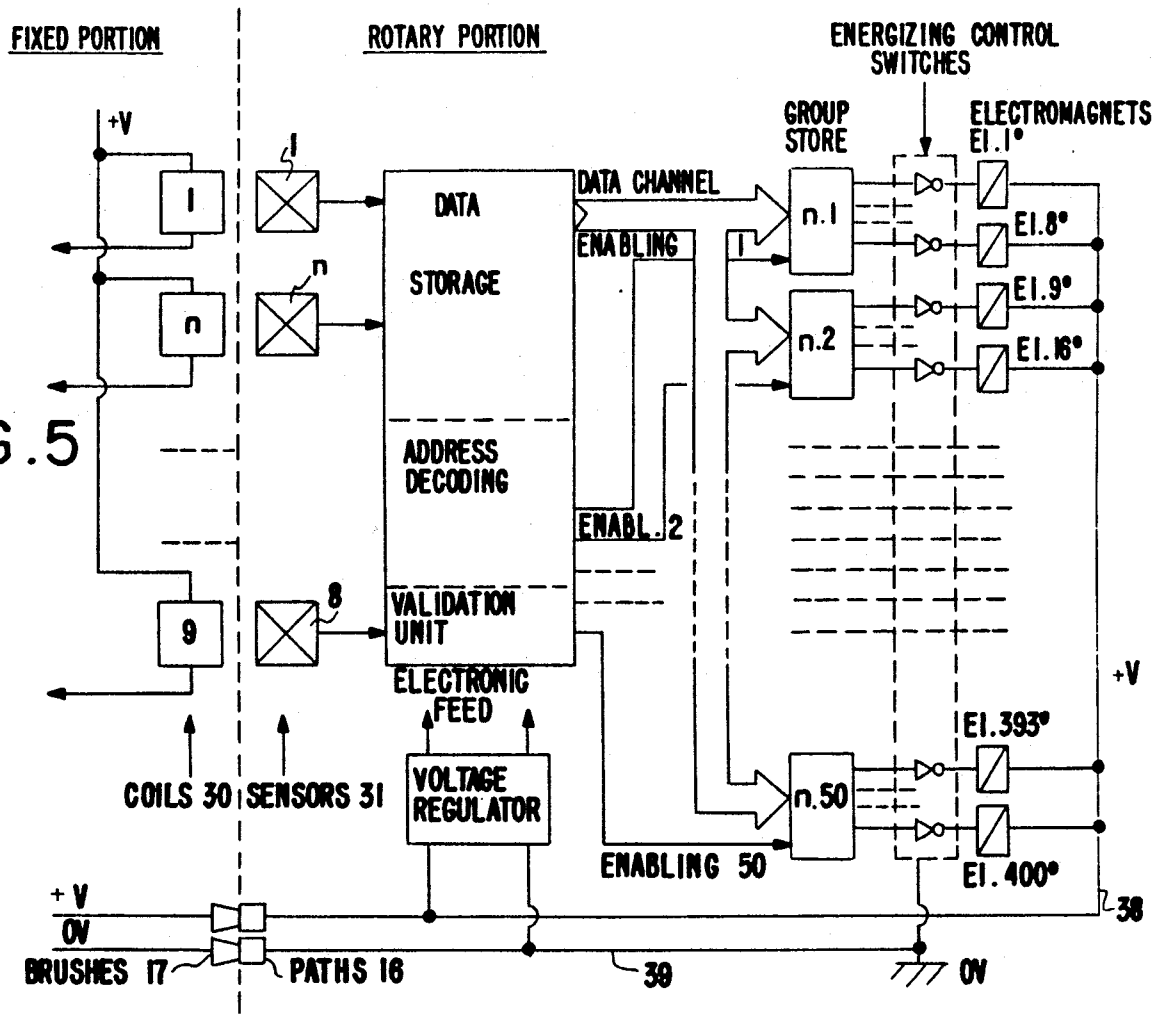
FIG. 5 is a schematic diagram of a power transmission system.

The block diagram of the rotating electronic system on the cylinder is shown in FIG. 5. The information in the form of current pulses is transferred from the windings 33, which are fed by the stationary electronic control system of the machine, to the coils 30 which transmit them as magnetic pulses to the sensors 31, which in their turn transmit them along the lines 36 to the electronic system on the rotating cylinder.

The information consists of 8 pulses in binary code, one for each electromagnet, which is to be either energized or not energized, and is completed by the address which identifies the group of electromagnets to which the information is directed.

That part of the information comprising said sequence is memorized by the central data memory, indicated by 17 in FIG. 3, and is transmitted from here to all the 50 memories of the groups of control electromagnets, indicated by 17' in FIG. 3, whereas the address decoder unit enables, for the purpose of receiving this data sequence, only the memory of those groups for which the information is intended.

As already stated with reference to FIG. 3, the mobile assembly derives its power from one or more pairs of sliding contacts with transmission conductors or tracks 16. This power transmission by sliding contacts is of conventional type and is illustrated by way of example in FIG. 5.

The contact tracks are traversed by contact shoes or brushes 37. The electricity fed to the electronic system is subjected to voltage control and stabilization to prevent disturbances.

Electricity is fed to the electromagnets via a positive line 38 and earth line 39.

The memory of the receiving group fed with the information then transmits orderly and simultaneously the on/off energization command to the energization switches of its electromagnets. The progress of the transmission process with time is shown in FIG. 6 both in terms of information and validation transmission. As already described with reference to FIG. 3, the mobile assembly derives its power from one or more pairs of sliding contacts comprising transmission conductors or tracks 16. Power transmission using sliding contacts is of conventional type and is shown by way of example in FIG. 5.

The contact tracks 16 are provided in one or more pairs, one conductor of each pair being connected to positive and the other to earth.

The tracks are traversed by contact shoes or brushes 37. The electricity feed to the electronic system is preferably subjected to voltage control and stabilization to prevent disturbances. Electricity is fed to the electromagnets via a positive line 38 and earth line 39.

The on/off data sequence $D_{n1-n8}$ relative to the needles or needle electromagnets of the nth group of needles of the circular machine is fed via the transmission lines 1–8 and are confirmed by signal return along line 9. The address $A_n$ of the nth group is then transmitted and is confirmed by the second signal return along line 9. With the second validation the information relative to the on/off data sequence is fed into the memory of the nth group of needles, which is to receive this information.

Each group must receive information relative to all 8 needles. After this, the address is changed to that of the next group to be switched, and only to that, and also keeping a check on the mechanical synchronization, i.e. that the timed operations of the electronic control system correspond to the angular velocity of the machine, or in other words that the change of address takes place after eight needles have been effectively presented to a synchronization monitoring sensor.

This synchronization check is typically effected at the centre of the group, between the 4th and 5th needle.

The entire remote transmission operation for the group of 8 needles is completed in a time of less than one hundred microseconds.

The transmission procedure described up to this point can be conducted with just 9 buses or transmission channels.

Alternatively, if it is preferred not to have to feed the data and the addresses consecutively, it is possible to transmit them simultaneously by using 8 buses for the data, 6 buses for the address and one bus for the validation.

The validation signal is necessary to identify the moment $t_1$ when the fed signals relate to command data D and differentiate it from the moment $t_2$ in which the fed signals relate to the address A. The validation signal is also useful for signal stability reasons. In this respect, it must be remembered that within one revolution of the machine, which can take just one twentieth of a second or less, the entire 400 needles, i.e. in the case considered the 50 needle groups, must undergo a number of selections equal to the number of feed stations. In a circular machine with four feeds and with the needles divided into groups of eight, it must therefore be possible to switch 50 groups of needles four times in one twentieth of a second. This requires data transmission every 250 microseconds, and the data memorization must be by a stable signal over all transmission channels.

The validation signals are emitted after a time (in terms of microseconds) which is sufficient to provide signal stability over all the inductive transmission channels or buses, and at the right time for the data to be written into the destination memory.

The coils 30 can be advantageously energized with direct current at a voltage of the order of some tens of volts, and typically at the voltage available for energizing the electromagnets on the cylinder.

I claim:

1. A device for controlling needle selection in a circular knitting machine by electromagnetic actuators, one per needle, rotating with a needle cylinder, comprising a fixed electronic control system for transmitting digital control information to a rotating needle selection assembly, without any direct contact therebetween, via transmission channels having fixed circular magnetic coils surrounding the needle cylinder and sensors provided in the rotating needle selection assembly, said sensors being positioned for each to correspond with one of said magnetic coils and to travel along a circular contour of said magnetic coil to receive magnetic pulses generated by said magnetic coil along the entire path, said sensors consisting of Hall sensors for generating electrical signals proportional to the magnetic pulses received from the magnetic coil along which said sensor travels, and transmit said electrical signals to the rotating needle selection assembly.

2. A device for controlling needle selection in a circular knitting machine as claimed in claim 1, wherein the rotating needle selection assembly further comprises a memory combined with a central decoder unit, for feeding other operational memories, said operational memories being connected to energization switches for the electromagnetic actuators to transmit control signals to the electromagnetic actuators.

3. A device for controlling needle selection in a circular knitting machine as claimed in claim 1, wherein said magnetic coils further comprise a circularly extending channel section, said circularly extending channel section comprising a cavity, in which there is provided a multiturn winding, said multiturn winding is energized with electric current to induce a magnetic polarity in the pole pieces of the channel section.

4. A device for controlling needle selection in a circular knitting machine as claimed in claim 1, wherein said sensor further comprises ferromagnetic plates for concentrating magnetic flux onto said Hall sensor.

5. A device for controlling needle selection in a circular knitting machine as claimed in any one of claims 1, 2, 3, or 4 wherein the circular knitting machine is a 400 needle circular machine, said needles are divided into fifty groups of eight needles each, thus enabling the binary code command to be transmitted via nine transmission channels, one of which is reserved for the validation signals.

6. A method for remote transmission of commands to a rotating needle selection assembly in a circular knitting machine, comprising transmitting binary code selection control information to said assembly wherein both on/off commands for electromagnetic actuators are provided for selection of needles of a group of equal numbers of needles from a total number of needles of the circular knitting machine, said transmitting being done simultaneously for the entire group, said on/off command identifies an address for a group of said electromagnetic actuators corresponding to said group of needles.

7. A method for remote transmission of commands to the rotating needle selection assembly in a circular knitting machine as claimed in claim 6 wherein the information transmitted in binary code further comprises determining from validation signals a moment of transmission to a memory of a destination group.

8. A method for the remote transmission of commands to the rotating needle selection assembly in a circular knitting machine as claimed in claim 7, further comprising providing the validation signals with a variable delay, after the transmission of the information, to insure stability of the signal over all channels.

* * * * *